US005673719A

United States Patent [19]

Shofner

[11] Patent Number: 5,673,719

[45] Date of Patent: Oct. 7, 1997

[54] CRUTCH ASSEMBLY

[76] Inventor: Martin K. Shofner, 6109 Jocelyn Hollow Rd., Nashville, Tenn. 37205

[21] Appl. No.: 549,473

[22] Filed: Oct. 27, 1995

[51] Int. Cl.[6] ..... A61H 3/02

[52] U.S. Cl. ..... 135/68; 135/73

[58] Field of Search ..... 135/65, 68, 69, 135/71–76

[56] References Cited

U.S. PATENT DOCUMENTS

| | | | |
|---|---|---|---|
| 1,183,008 | 5/1916 | Hipwood | 135/68 |
| 1,288,929 | 12/1918 | Kornstein | 135/68 |
| 2,473,671 | 6/1949 | Yackley | 135/68 |
| 4,245,659 | 1/1981 | Shofner . | |
| 4,386,466 | 6/1983 | Lee | 135/69 X |
| 4,733,682 | 3/1988 | Ellena | 135/69 |
| 5,113,887 | 5/1992 | Herman | 135/68 |
| 5,165,436 | 11/1992 | Hall | 135/68 |

*Primary Examiner*—Lanna Mai
*Attorney, Agent, or Firm*—Hale and Dorr LLP

[57] ABSTRACT

A crutch assembly having right and left leg members and a horizontal cross-body member. The right and left legs can swivel both forward and backward and from side to side. Swivel joints contained within the aluminum tubing provide for the movement of the legs.

13 Claims, 5 Drawing Sheets

CRUTCH ASSEMBLY

BACKGROUND OF THE INVENTION

The present invention relates to crutches, and is an improvement upon the crutch assembly described in my prior U.S. Pat. No. 4,245,659.

It is an object of the present invention to provide a crutch that provides the advantages of my prior crutch assembly, but which also is lighter in weight, more convenient to use, and less expensive to manufacture.

SUMMARY OF THE INVENTION

The crutch assembly of the present invention features right and left leg members and a horizontal cross-body member. Typically, the legs and the cross-body member are cylindrical aluminum tubing. The right and left legs can swivel independently both forward and backward and from side to side. The joints providing for this movement are contained completely within the aluminum tubing.

In a preferred embodiment, the cross-body member is generally U-shaped, one end of "U" extends to the right side of the user and is connected to the right leg member, and the other end of the "U" extends to the left side of the user and is connected to the left leg member.

A swivel joint in the cross-body member allows each of the leg members to pivot in a forward and backward direction, and additional swivel joints located at the connecting points between the cross-body member and the leg members allow the leg members to pivot side to side.

In the disclosed preferred embodiment, each swivel joint is completely contained within the aluminum tubing and is comprised of a bolt having a bolt head at one end and a lock nut at the opposite end and nylon rods fitted within the tubes which surround the bolt. The nylon rod ends abut at the same position where the aluminum tube of the leg member meets the aluminum tube of the cross-body member.

BRIEF DESCRIPTION OF THE DRAWINGS

Other objects, features and advantages of the invention will be apparent from the further description, together with the drawings in which.

DESCRIPTION OF A PREFERRED EMBODIMENT

Figure 1:
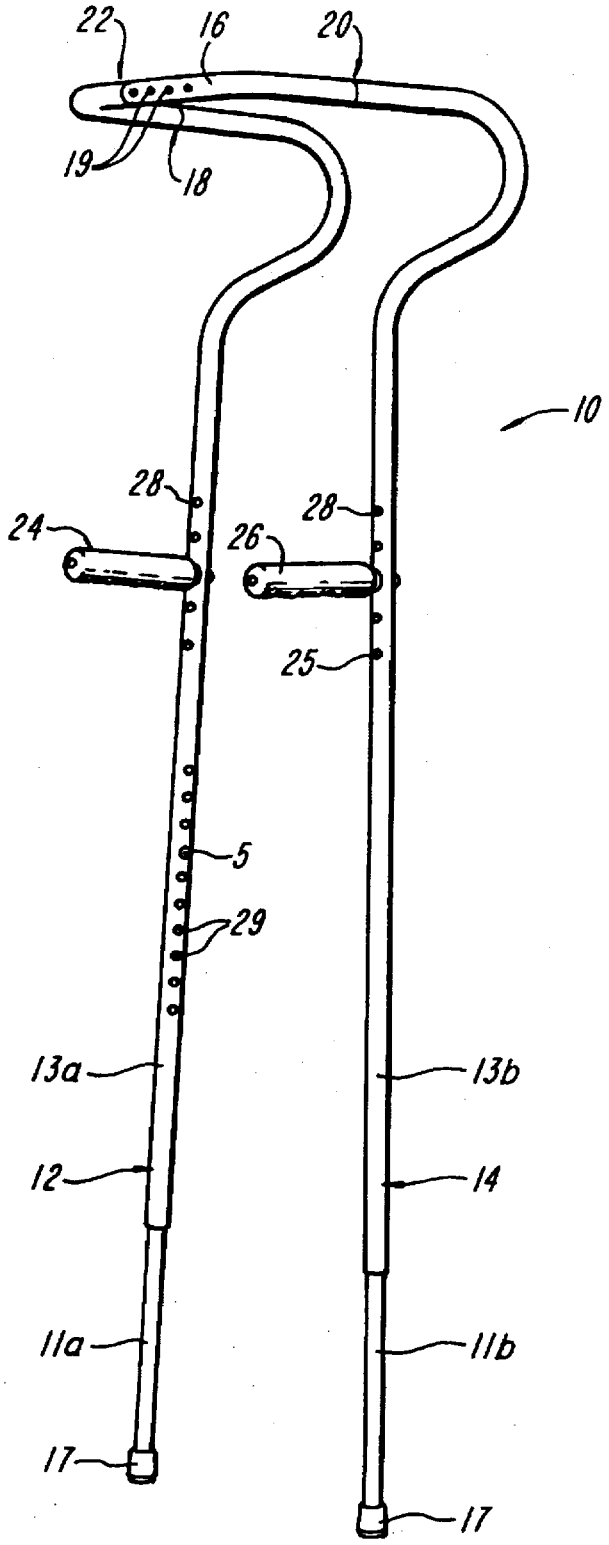
FIG. 1 is a perspective view of the crutch of the present invention.

As shown in FIGS. 1–7, the crutch 10 of the illustrated preferred embodiment comprises a horizontal, generally U-shaped cross-body member 16, the opposite ends of which, i.e., the ends under the user's arms, are connected to crutch legs 12 and 14 at swivel joints 18 and 20, respectively. In the illustrated embodiment, the cross-body member 16 and legs 12, 14 are aluminum tubing. Typically, rubber tips 17 are provided on the bottom of each leg.

Figure 4:
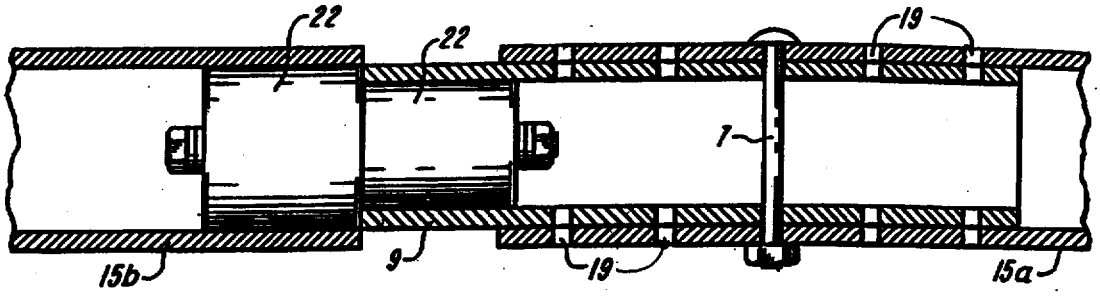
FIG. 4 is a top plan view, partially in section, of a portion of the cross-body member of the crutch.
Figure 5:
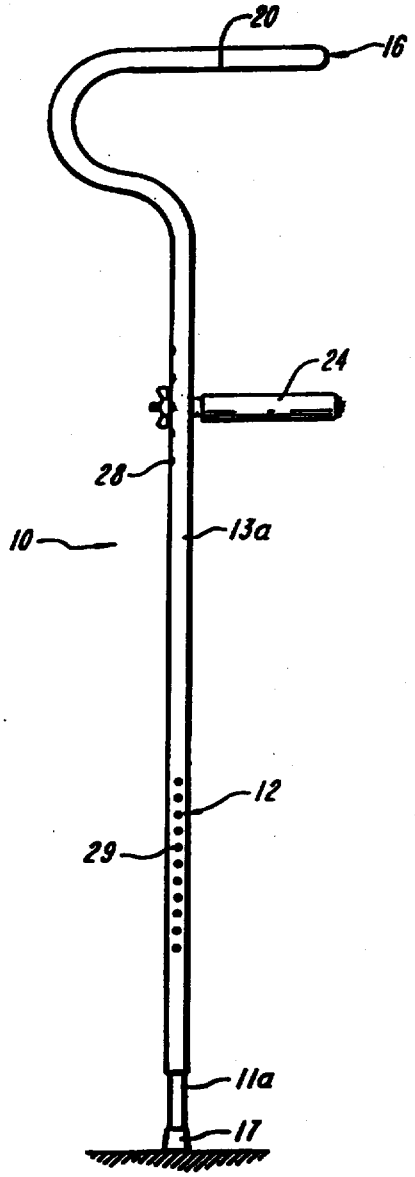
FIG. 5 is a side plan view of the crutch.

As shown most clearly in FIG. 4, cross-body member includes two generally L-shaped tubes 15*a*, 15*b*, each of which typically has an about ⅞ inch outer diameter and extends from the front of the user 30 to under one of the user's arms. Tubes 15*a*, 15*b* are connected together by a straight tube 9 which has a slightly smaller outer diameter so that it will fit within, and form a close slip fit with, tube 15*a*. As shown, the end of tube 15*a* at the front right side of the user fits over, and is axially aligned with, the adjacent end of straight tube 9. Through holes 19 are provided at intervals along the adjacent overlapping portions of tube 15*a* and straight tube 9 so that the adjacent ends of tube 15*a* and straight tube 9 may be fixed relative to each other as desired by through bolts 7 or other connectors. This arrangement permits the width of the crutch 10 to be adjusted a few inches on either side of a median width of about 15 inches.

The other end of straight tube 9, at the left side of the front of the user, is coaxially aligned with and connected to the adjacent end of tube 15*b* by swivel joint 22. Joint 22 permits tube 15*b* to rotate relative to tube 9 (and also to tube 15*a* to which the other end of tube 9 is connected) about an axis that is generally horizontal, and coaxial with the front of cross-body member 16. This rotation of tubes 15*a* and 15*b*, permitted by swivel joint 22, allows crutch legs 12 and 14 to pivot backwards and forwards in opposite directions relative to each other in places generally perpendicular to the axis of the portion of cross-body member 16 at the front of the user.

Swivel joints 18 and 20 at the opposite ends of cross-body member 16 connect crutch legs 12, 14 to the underarm ends of cross-body member tubes 15*a*, 15*b*, in axial alignment with the respective tube. Joints 18, 20 permit the legs 12, 14 to pivot from side to side, about axes that are generally perpendicular to that about which swivel joint 22 permits relative rotation of tubes 15*a*, 15*b*. Preferably, joints 18, 20 each permit movement of a respective leg 12, 14 through a total arc of at least 180° and both towards and away from the user.

A handle 24, 26 that the user may grasp is provided on each leg 12, 14. The location of the handles along the respective legs is adjustable. In the illustrated embodiment, the handles are located about 15 inches from the top of the legs 12, 14, and are attached to the legs by wing nuts. Holes 28 are provided at approximately 1" intervals in the cylindrical tube of each leg, so that the point of attachment of the handles may be adjusted by users having different heights and arm lengths.

The legs 12, 14 can also be adjusted for variations in the user's height. Each leg of the crutch includes a pair of telescoping cylindrical tubes; leg 12 includes tubes 11*a* and 13*a* and leg 14 includes tubes 11*b* and 13*b*. Tubes 11*a*, 11*b* have a slightly smaller diameter than do tubes 13*a*, 13*b*. Each of tubes 11*a*, 11*b* slips (forming a close slip fit) within respective one of the larger diameter tubes 13*a*, 13*b* and can be extended out of or retracted into the larger diameter tube to adjust the overall length of the leg, and thus the height of the crutch, to the height of user. In the illustrated embodiment, the adjustment is provided by radially-projecting, spring-loaded push buttons 5 in each inner tube 11*a*, 11*b* which project through one of a series of vertically spaced holes 29 in the respective outer tube 13*a*, 13*b*. A typical overall length of legs 12, 14 is about 43 inches.

In the illustrated preferred embodiment, the overall front to rear dimension of crutch 10 is about 12 inches. The top of each leg 12, 14 extends (from the point at which it is connected to a respective end of cross-body member 16)

rearwardly to behind the user's back, and then curves forwardly to a point more midway the user's back and front from which the rest of the leg extends generally downwardly.

Figure 2:
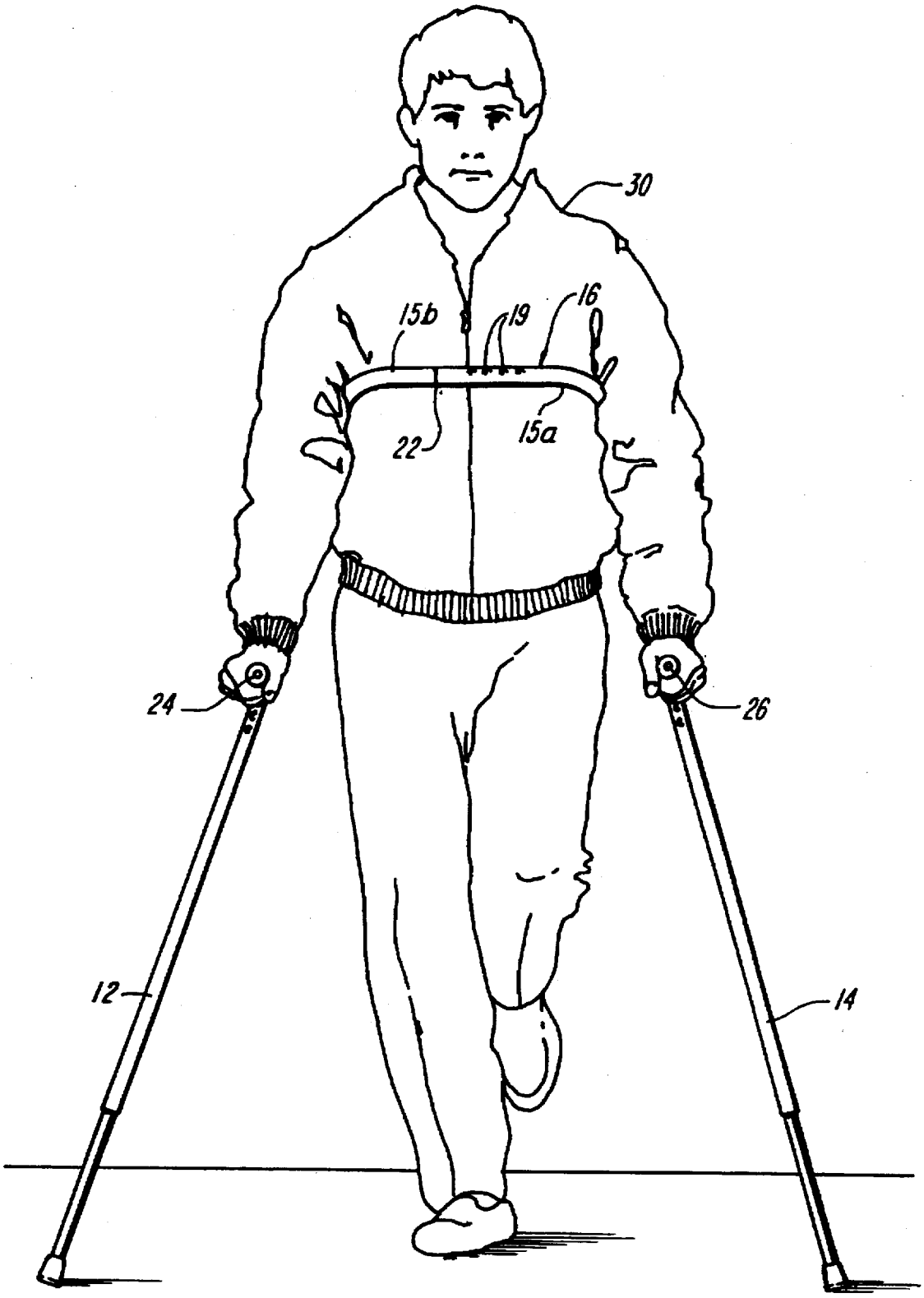
FIG. 2 is a front view of the crutch in use.

FIG. 2 shows the crutch in use from a front view. A user 30 places the cross-body member 16 under his arms and across his chest. The user's arms are in front of the indented portion of the legs 12 and 14, and the user grasps handle 24 with his right hand and handle 26 with his left hand. The swivel joints 18, 20 allow the legs 12 and 14 to pivot out away from the user, as desired.

Figure 3A:
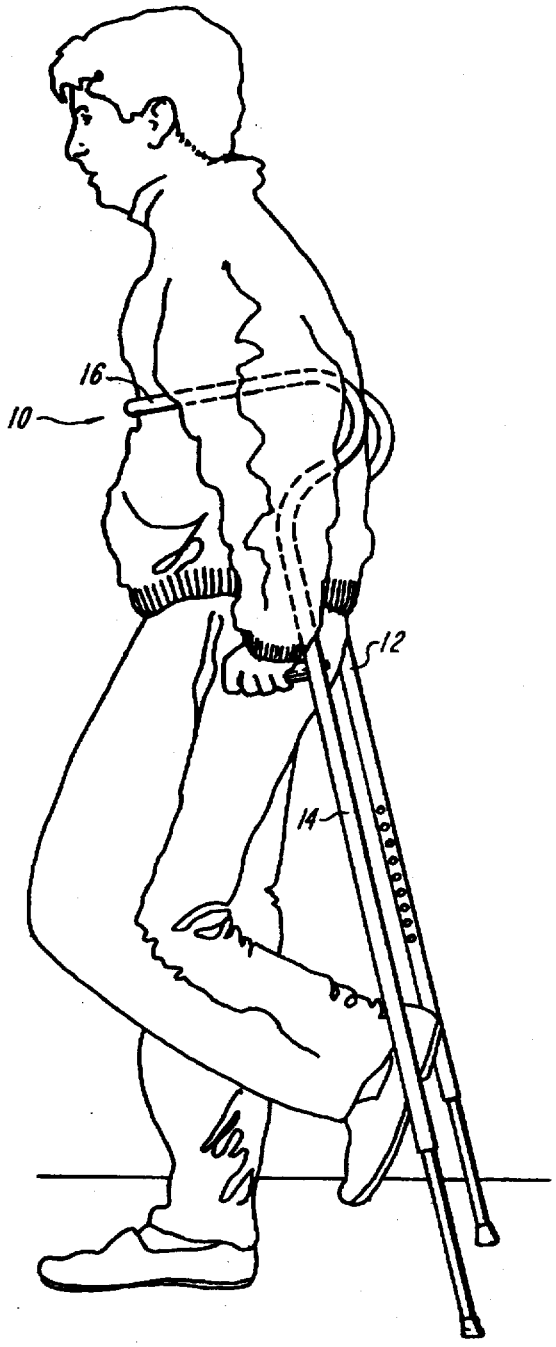
FIGS. 3(A) and 3(B) are side views of the crutch in use.
Figure 3B:
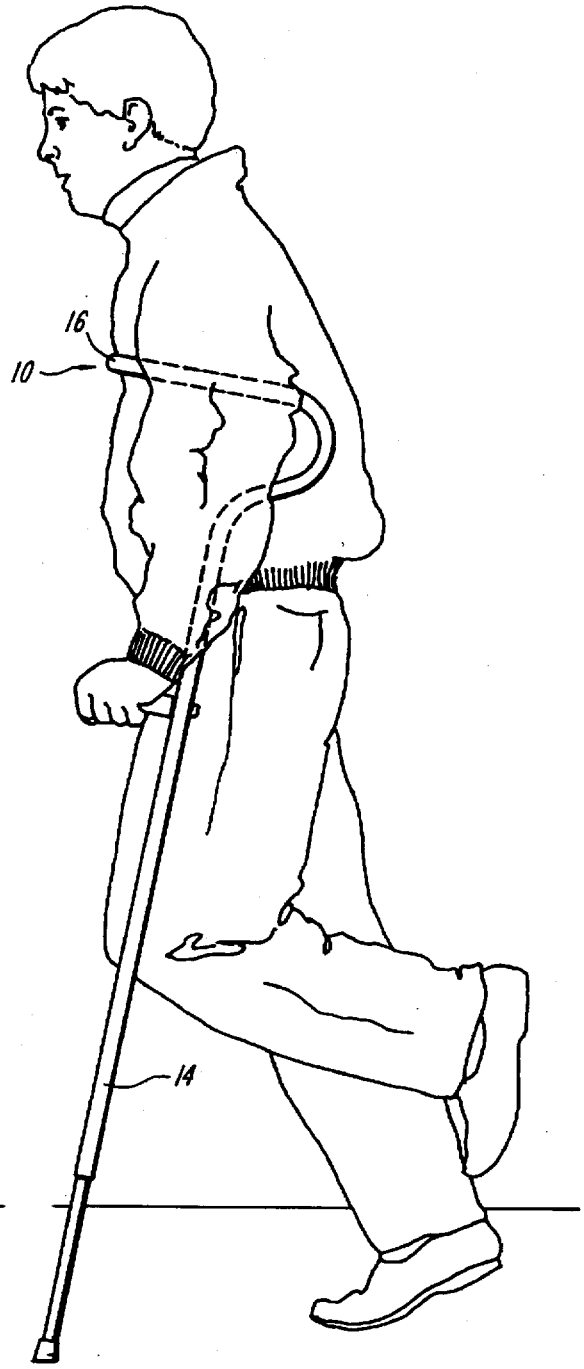

FIGS. 3A and 3B show the crutch in use from a side view. The user 30 holds the crutch 10 in front of him. The horizontal cross-body member 16 extends in front of his chest, and under his arms. The crutch surrounds the user on three sides, and then curves back down so that the legs of the crutch are parallel to the user's legs when both are in an upright position. Swivel joint 22 allows the legs to move, backwards and forwards, independently of each other.

Figure 6:
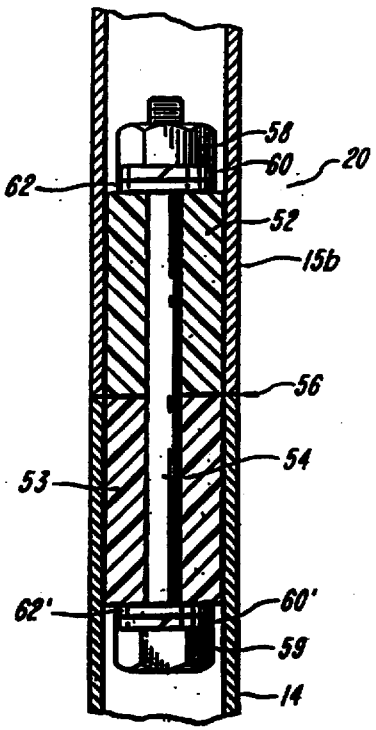
FIG. 6 is a sectional view showing a swivel joint in detail.

FIG. 6 illustrates the construction of the swivel joint 20 connecting tube **15*b* of cross member 16 to leg 14 in greater detail. As shown, one end of swivel joint 22 is contained within an end of tube 15*b*, and the other end of the swivel joint is within the adjacent end of leg 14. The end of swivel joint 22 within tube 15*b* comprises a hollow nylon rod 52 press-fitted within tube 15*b*. A similar hollow nylon rod 53 is press fitted within the end of leg 14. Since the aluminum tubes forming tube 15*b* and the upper tube 13*b* of leg 14 generally have the same inside diameter, the two nylon rods 52, 53 typically are made simply by cutting a single longer rod into two pieces. The adjacent ends of nylon rods 52, 53 abut each other adjacent the ends of the respective tubes 15*b*, 17, forming a joint 56. A ¼" bolt 54 extends coaxially through both rods 52, 53** and connects them together.

A lock nut 58 is at the opposite end from the bolt head 59, and lock washers 60, 60' and washers 62, 62' are at either end of the nylon rod. Rotation of rods 52, 53 about bolt 54 thus allows the leg 14 to rotate relative to the tube **15*b* of cross-member 16** located on the other side of the joint.

The swivel joints 18, 22 provided, respectively, between leg 12 and tube **15*a* and between tube 9 and tube 15*b* are essentially identical. The only difference is that, in swivel joint 22, since tube 9 has a smaller inside diameter than does tube 15*b***, the two nylon rods must be of different diameter to provide the desired press fit between each rod and the tube into which it is inserted.

Figure 7:
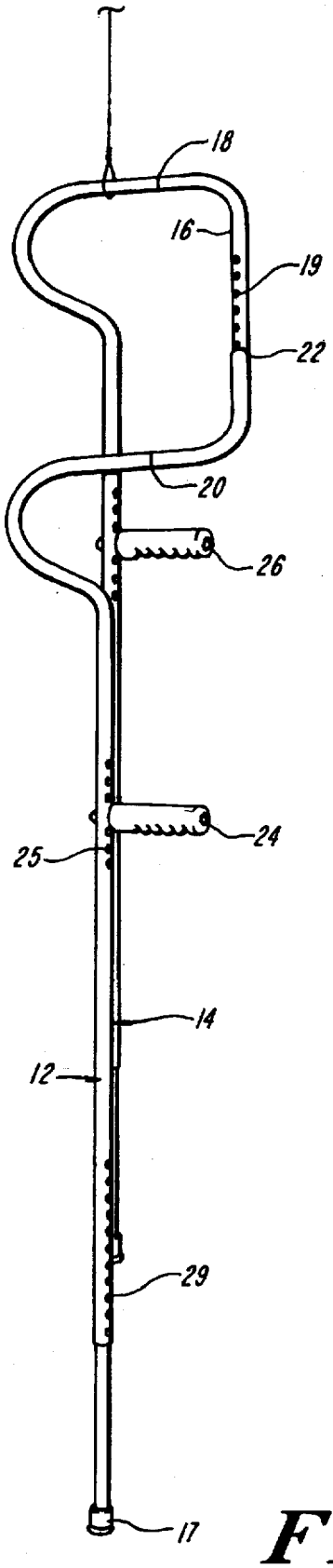
FIG. 7 is a perspective view of the crutch in a hanging configuration.

FIG. 7 shows the crutch of the present invention hung for storage. As shown, swivel joints 18 and 20 permit the entire assembly to pivot so that the crutch legs 12, 14 and the cross-body member 16 are all essentially vertical.

While the foregoing invention has been described with reference to a particular embodiment, it should be understood that various modifications and alterations will occur to those practiced in the art.

What is claimed is:

1. A crutch assembly comprising:

two vertical crutch legs, each crutch leg arranged to extend generally upwardly from the floor; and a horizontal cross-body member, an upper portion of each of said crutch legs being connected to said cross-body member, and each of said crutch legs being pivotable in a forward and backwards direction generally perpendicular to at least a portion of said cross-body member and in a side to side direction generally perpendicular to said forward and backwards direction.

2. The crutch assembly of claim 1 further comprising a joint in a central portion of said cross-body member, said joint allowing relative movement of portions of said cross-body member on opposite sides of said joint to permit said crutch legs to pivot relative to each other in planes generally perpendicular to said cross-body member.

3. The crutch assembly of claim 2 wherein said joint is a swivel joint.

4. The crutch assembly of claim 1 further comprising joints, each of which connects a respective end of said cross-body member to a respective one of said crutch legs, each of said joints allowing the respective one of said crutch legs to pivot side to side relative to said cross-body member about an axis generally perpendicular to a central portion of said cross-body member.

5. The crutch assembly of claim 4 wherein each of said joints is a swivel joint.

6. The crutch assembly of claim 5 wherein a third swivel joint is provided in said central portion of said cross-body member, said third joint permitting each of said crutch legs to pivot relative to said central portion of cross-body member in planes generally perpendicular to said central portion.

7. The crutch assembly of claim 6 wherein each of said swivel joints comprises:

a first rod contained within and fixed relative to a first tube;

a second rod contained within and fixed relative to a second tube;

a cylindrical member extending coaxially through said first and second rods and permitting relative rotation of said first and second rods about the axis of said cylindrical member.

8. The crutch assembly of claim 7 wherein said cylindrical member is a bolt having a bolt head at one end and a lock nut at the opposite end, and wherein said swivel joint further comprises a first washer adjacent to one end of said cylindrical member and located in said first tube and a second washer adjacent to the opposite end of said cylindrical member and located in said second tube.

9. The crutch assembly of claim 8 wherein said first and second rods are nylon rods, and wherein each of said rods is press-fitted within the respective one of said first and second tubes.

10. The crutch assembly of claim 5 a portion of one of said swivel joints being located within tubing comprising one of said crutch legs and another portion of said swivel joint being located within tubing comprising said cross-body member.

11. The crutch assembly of claim 1 wherein said cross-body member and said crutch legs of said crutch assembly are comprised of aluminum tubing.

12. A crutch assembly comprising:

right and left crutch legs, each of said crutch legs being comprised of tubing and arranged to extend upwardly from the floor;

a cross-body member comprising a first tube, a second tube extending from said first tube and being connected to said right crutch leg member and a third tube extending from said first tube and being connected to said left crutch leg member;

a first swivel joint connecting said first tube to one of said second and third tubes, said joint allowing said first tube to pivot relative to said one of said second and third tubes about a first axis generally coaxial with said first tube;

a second swivel joint located at the connecting point between said second tube and said right crutch leg member, said joint connecting second tube to said right crutch leg in generally coaxial alignment and allowing said right crutch leg to pivot relative to said second tube about a second axis generally perpendicular to said first axis; and a third swivel joint located at the connecting point between said third tube and said left crutch leg, said joint connecting the third tube to said left crutch leg in generally coaxial alignment and allowing said left leg to pivot relative to said third tube about a third axis generally perpendicular to said first axis.

13. A crutch assembly comprising:

a horizontal cross-body member, a central portion of said cross body member extending generally along a first axis; and two vertical crutch legs extending upwardly from the floor to said cross body member, each of said crutch legs being connected to said cross-body member, and each of said crutch legs being pivotable about said first axis, one of said crutch legs further being pivotable about a second axis and the other of said crutch legs further being pivotable about a third axis, said second and third axes being substantially perpendicular to said first axis.

* * * * *